US007339600B2

(12) United States Patent
Hwang

(10) Patent No.: US 7,339,600 B2
(45) Date of Patent: Mar. 4, 2008

(54) APPARATUS AND METHOD FOR DISPLAYING A PICTURE IN A WIRELESS TERMINAL

(75) Inventor: Soon-Shik Hwang, Gumi-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 57 days.

(21) Appl. No.: 11/101,442

(22) Filed: Apr. 8, 2005

(65) Prior Publication Data

US 2005/0237298 A1 Oct. 27, 2005

(30) Foreign Application Priority Data

Apr. 26, 2004 (KR) ..... 10-2004-0028704

(51) Int. Cl.
*G09G 5/00* (2006.01)

(52) U.S. Cl. ..... 345/659; 345/658; 345/660; 345/665

(58) Field of Classification Search ..... 345/649, 345/653–54, 658–60, 664–65, 670–71, 658–660, 345/671; 382/296–301; 455/550.1, 566, 455/575.1, 457, 556.1, 556.2
See application file for complete search history.

(56) References Cited

U.S. PATENT DOCUMENTS 5,798,750 A * 8/1998 Ozaki ..... 345/656
6,466,198 B1 * 10/2002 Feinstein ..... 345/158
2003/0064758 A1 * 4/2003 Mizuta et al. ..... 455/566
2003/0157372 A1 * 8/2003 Ozawa et al. ..... 428/694 BP
2003/0203747 A1 * 10/2003 Nagamine ..... 455/566
2004/0092284 A1 * 5/2004 Satoh et al. ..... 455/550.1
2004/0185878 A1 * 9/2004 Woo ..... 455/457
2004/0185920 A1 * 9/2004 Choi et al. ..... 455/575.1
2004/0198474 A1 * 10/2004 Jung et al. ..... 455/575.1
2004/0203532 A1 * 10/2004 Mizuta ..... 455/575.1

(Continued)

FOREIGN PATENT DOCUMENTS

CN 1469671 1/2004

(Continued)

OTHER PUBLICATIONS

Subscriber Identity Module, Wikipedia, http://en.wikipedia.org/wiki/SIM.*

*Primary Examiner*—Chante Harrison
(74) *Attorney, Agent, or Firm*—Roylance, Abrams, Berdo & Goodman, L.L.P.

(57) ABSTRACT

A display apparatus and method for use in a wireless terminal are provided. A direction signal is sensed according to a position in which the wireless terminal is placed. A case when no direction signal is sensed is determined as a first direction signal, and display data is output and displayed in a standard direction. When the sensed direction signal is a second direction signal, the display data is rotated by 90°, the rotated display data is compressed, and the compressed rotated display data is displayed. When the sensed direction signal is a third direction signal, the display data is rotated by 180°, and the rotated display data is displayed. When the sensed direction signal is a fourth direction signal, the display data is rotated by 270°, the rotated display data is compressed, and the compressed rotated display data is displayed.

20 Claims, 10 Drawing Sheets

U.S. PATENT DOCUMENTS

| | | | | |
|---|---|---|---|---|
| 2004/0214612 | A1* | 10/2004 | Park et al. | 455/566 |
| 2005/0143124 | A1* | 6/2005 | Kennedy et al. | 455/556.1 |
| 2005/0184993 | A1* | 8/2005 | Ludwin et al. | 345/502 |
| 2006/0146009 | A1* | 7/2006 | Syrbe et al. | 345/156 |

FOREIGN PATENT DOCUMENTS

| | | |
|---|---|---|
| JP | 1020010000127 | 1/2001 |

* cited by examiner

APPARATUS AND METHOD FOR DISPLAYING A PICTURE IN A WIRELESS TERMINAL

PRIORITY

This application claims the benefit under 35 U.S.C. 119(a) of an application entitled "APPARATUS AND METHOD FOR DISPLAYING A PICTURE IN WIRELESS TERMINAL", filed in the Korean Intellectual Property Office on Apr. 26, 2004 and assigned Serial No. 2004-28704, the entire contents of which are incorporated herein by reference.

BACKGROUND OF THE INVENTION

1. Field of the Invention

The present invention generally relates to an apparatus and method for displaying a picture in a wireless terminal. More particularly, the present invention relates to an apparatus and method by which a user can view a picture in a standard direction, regardless of a direction in which a wireless terminal is placed.

2. Description of the Related Art

Currently, wireless terminals are developing into a structure capable of transmitting high-speed data in addition to a voice communication function. That is, when a mobile communication system of the International Mobile Telecommunications-2000 (IMT-2000) standard is implemented, a high-speed data communication function as well as the voice communication function can be performed using the wireless terminals. Data capable of being processed in the wireless terminal performing the data communication function can be packet data and picture data.

Wireless terminals have become equipped with a camera or television (TV) receiver, allowing the terminals to display a video signal. Thus, wireless terminals equipped with cameras can take pictures to display moving and still pictures, and can transmit the pictures. Wireless terminals equipped with a TV receiver can display a picture signal.

Generally, wireless terminals display a picture signal in a fixed state, regardless of a direction in which the terminal is placed. That is, a user can view the picture only from a fixed location. Accordingly, there is a problem in that the user may not normally view a displayed picture in a state in which a screen of the wireless terminal is rotated at a predetermined angle.

Wireless terminals with cameras display data in a standard direction in a preview mode, regardless of a direction in which the wireless terminal is placed. In an operating mode other than the preview mode, the wireless terminal displays data in the standard direction in a state in which a folder of the wireless terminal is rotated by 180°.

FIGS. 1A to 1E illustrate the operation of a conventional wireless terminal. FIG. 1A illustrates a state in which the folder of the wireless terminal is closed. FIG. 1B illustrates a state in which the folder of the wireless terminal is rotated 0°, that is, not rotated at all. FIG. 1C illustrates a state in which the folder of the wireless terminal is rotated by 270°. FIG. 1D illustrates a state in which the folder of the wireless terminal is rotated by 90°. FIG. 1E illustrates a state in which the folder of the wireless terminal is rotated by 180°.

Display data is output and displayed in the standard direction as illustrated in FIG. 1B illustrating the state in which the folder of the wireless terminal is rotated by 0°, and FIG. 1E illustrating the state in which the folder of the wireless terminal is rotated by 180°. However, display data is output and displayed in a rotation direction as illustrated in FIG. 1D illustrating the state in which the folder of the wireless terminal is rotated by 90°, and FIG. 1C illustrating the state in which the folder of the wireless terminal is rotated by 270°. In this case, there is a problem in that the user can usually only view a picture by rotating his or her head, for example, by 90° while maintaining the wireless terminal steady, or by rotating the wireless terminal 90° or 270° in relation to the user's head position.

SUMMARY OF THE INVENTION

Accordingly, the present invention has been designed to solve the above and other problems occurring in the prior art. Therefore, it is an object of the present invention to provide an apparatus and method that can automatically control a display direction of a picture such that a user can view the picture in a standard direction, regardless of a direction in which a wireless terminal is placed.

In accordance with an aspect of the present invention, the above and other objects can be accomplished by a display apparatus for use in a wireless terminal. The display apparatus comprises a direction sensing unit for sensing a direction according to a position in which the wireless terminal is placed, and generating first to fourth direction sensing signals; a control unit for outputting display data in a standard direction when the first direction sensing signal is generated, outputting the display data rotated by 90° and compressed when the second direction sensing signal is generated, outputting the display data rotated by 180° when the third direction sensing signal is generated, and outputting the display data rotated by 270° and compressed when the fourth direction sensing signal is generated; a memory unit comprising a first picture buffer for storing a value indicating a size of a first picture displaying the display data when the first and third direction sensing signals are generated, and a second picture buffer for storing a value indicating a size of a second picture displaying the display data when the second and fourth direction sensing signals are generated; and a display unit for displaying the display data.

In accordance with another aspect of the present invention, the above and other objects can be accomplished by a display method for use in a wireless terminal. The display method involves sensing a direction signal according to a position in which the wireless terminal is placed; determining, as a first direction signal, a case when no direction signal is sensed, and outputting and displaying display data in a standard direction; rotating the display data by 90°, compressing the rotated display data, and displaying the compressed rotated display data, when the sensed direction signal is a second direction signal; rotating the display data by 180°, and displaying the rotated display data, when the sensed direction signal is a third direction signal; and rotating the display data by 270°, compressing the rotated display data, and displaying the compressed rotated display data, when the sensed direction signal is a fourth direction signal.

BRIEF DESCRIPTION OF THE DRAWINGS

The above and other objects, features and other advantages of the present invention will be more clearly understood from the following detailed description taken in conjunction with the accompanying drawings, in which.

Throughout the drawings, the same or similar elements are denoted by the same reference numerals.

DETAILED DESCRIPTION OF EXEMPLARY EMBODIMENTS

Embodiments of the present invention will be described in detail herein below with reference to the accompanying drawings.

Additionally, in the following description, specific elements such as a picture size, a shape and size of a magnet, a mounting position of the magnet, a position of a sensor, a magnetic pole detected by the sensor, and so on have been provided as examples. Those skilled in the art will appreciate that the present invention is not limited to those examples.

For example, a wireless terminal with a camera in accordance with an embodiment of the present invention will be described. Of course, the present invention can be applied to a wireless terminal equipped with a television (TV) receiver as well as a wireless terminal not equipped with a camera.

Figure 1A:
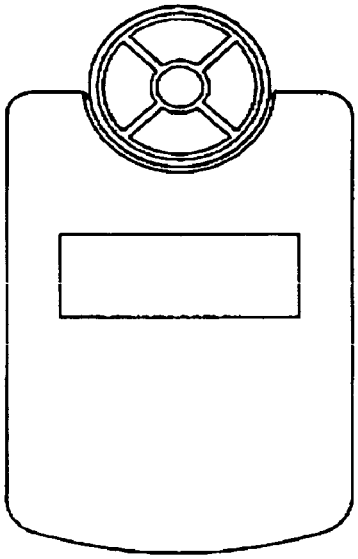
FIG. 1A (PRIOR ART)
FIGS. 1A to 1E are diagrams illustrating positions of a conventional wireless terminal.
Figure 1B:
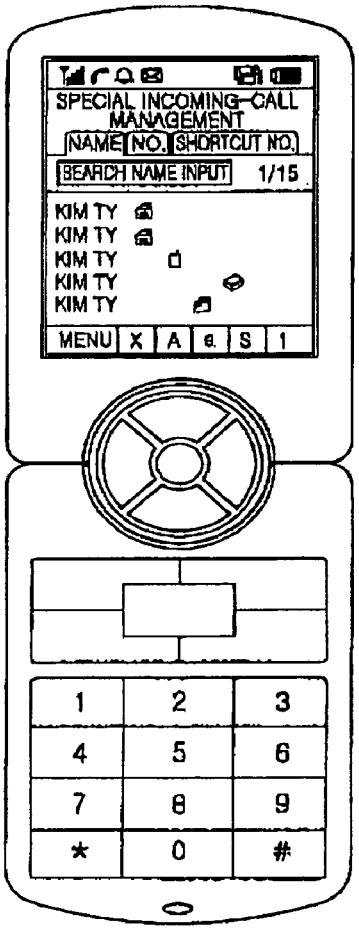
FIG. 1B (PRIOR ART)
Figure 1C:
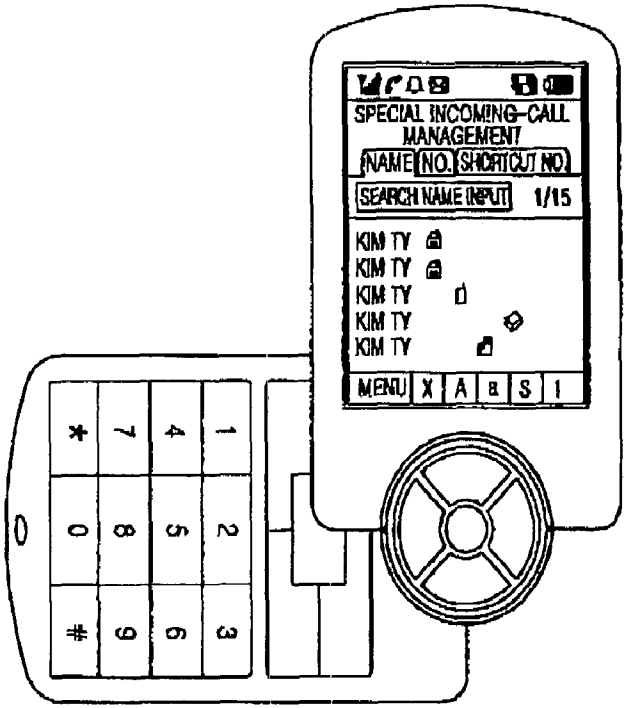
FIG.1C (PRIOR ART)
Figure 1D:
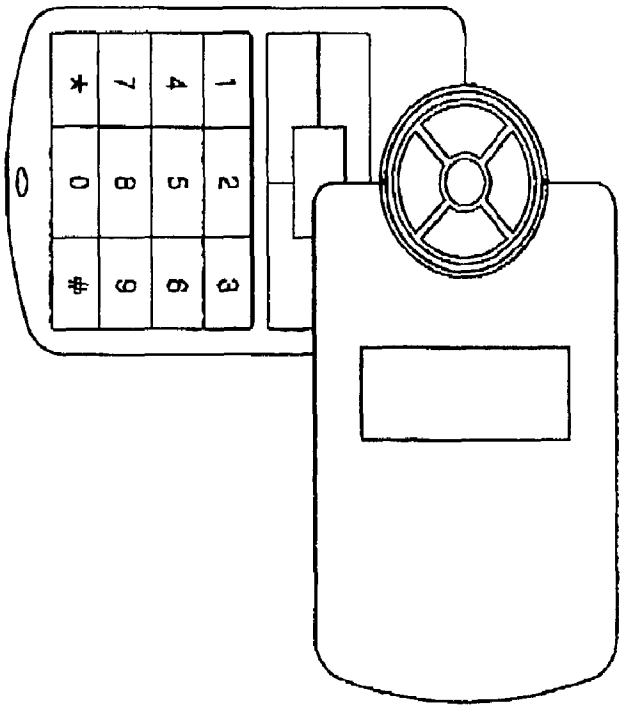
FIG.1D (PRIOR ART)
Figure 1E:
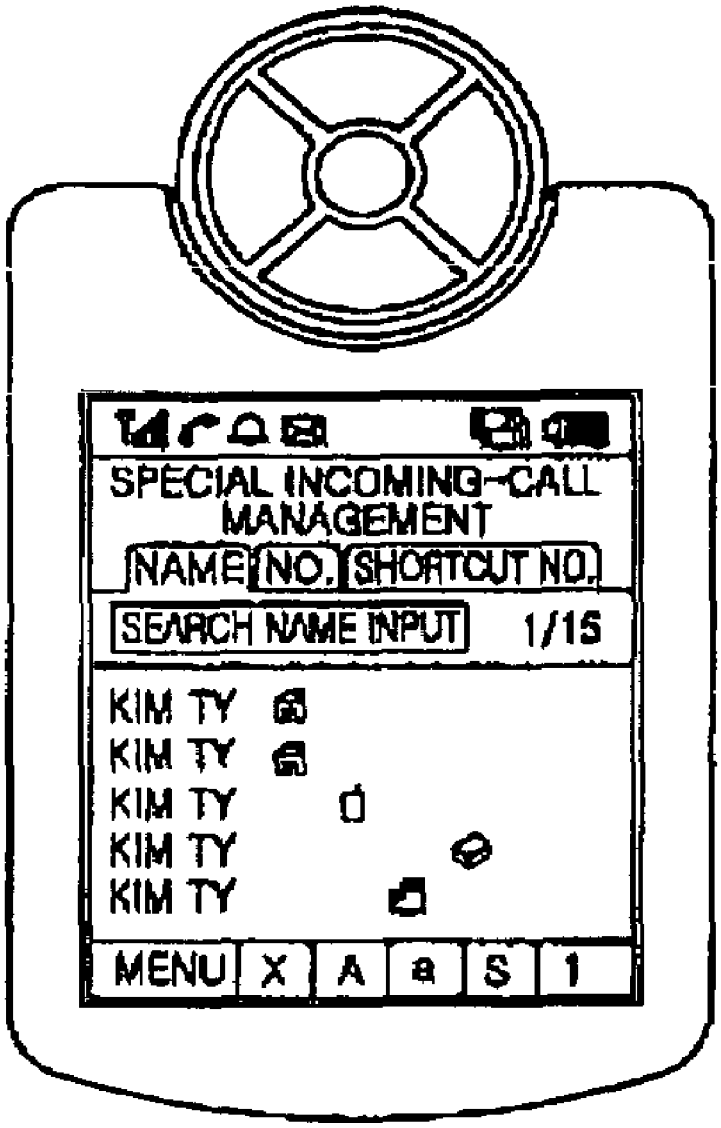
FIG. 1E (PRIOR ART)
Figure 2:
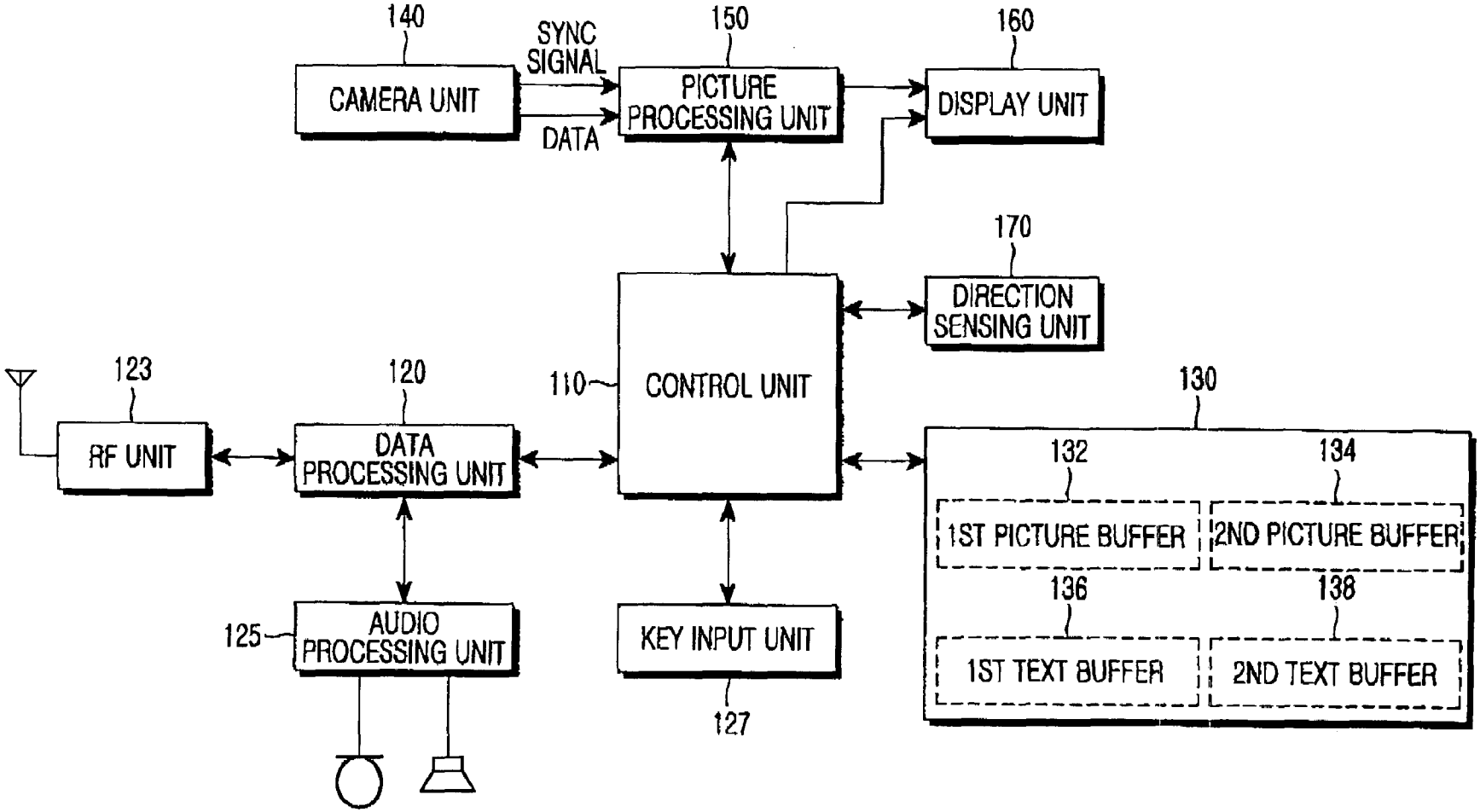
FIG. 2 is a block diagram illustrating a wireless terminal in accordance with an embodiment of the present invention.

FIG. 2 is a block diagram illustrating a wireless terminal in accordance with an embodiment of the present invention. Here, the wireless terminal is equipped with a camera.

Referring to FIG. 2, a radio frequency (RF) unit 123 performs a communication function of the mobile terminal. The RF unit 123 includes a RF transmitter (not shown) for up converting and amplifying a frequency of a signal to be transmitted, and a RF receiver (not shown) for low-noise amplifying a received signal and down converting a frequency of the received signal.

A data processing unit 120 includes a transmitter (not shown) for coding and modulating the signal to be transmitted and a receiver (not shown) for demodulating and decoding the received signal. That is, the data processing unit 120 can comprise a modulator-demodulator (MODEM) and a coder-decoder (CODEC). Here, the CODEC includes a data CODEC for processing packet data, and the like and an audio CODEC for processing an audio signal such as voice, and the like.

An audio processing unit 125 performs a function for reproducing a received audio signal output from the audio CODEC of the data processing unit 120 or outputting a transmission audio signal generated from a microphone to the audio CODEC of the data processing unit 120.

A key input unit 127 includes keys necessary for inputting number and letter information and function keys necessary for setting various functions. More specifically, the key input unit 127 can include a picture direction control key capable of manually controlling a direction of a picture to be displayed in accordance with an embodiment of the present invention.

A memory unit 130 can comprise program and data memories, and the like. The program memory can store programs for controlling general operation of the mobile terminal, and programs for controlling a display unit 160 to display a picture in a standard direction for a user in accordance with an embodiment of the present invention. The data memory performs a function for temporarily storing data generated while the programs are executed. More specifically, the memory unit 130 includes a first picture buffer 132 and a second picture buffer 134. When a direction sensing unit 170 generates a first direction signal and a third direction signal, the first picture buffer 132 stores information about a size, start position, and end position of a first picture for displaying data. In this embodiment of the present invention, it is assumed that the size of the first picture is 176*220, the start position information of the first picture is (176,0), and the end position information of the first picture is (176,220). In an embodiment of the present invention, it is assumed that the size of the first picture is the same as that of a first display area of the display unit 160 when the direction sensing unit 170 generates the first and third direction signals.

When the direction sensing unit 170 generates a second direction signal and a fourth direction signal, the second picture buffer 134 stores information about a size, start position, and end position of a second picture for displaying data. In an embodiment of the present invention, it is assumed that the size of the second picture is 140*176, the start position information of the second picture is (140,0), and the end position information of the second picture is (140,176). When the direction sensing unit 170 generates the second and fourth direction signals in accordance with an embodiment of the present invention, it is assumed that the second picture size is a compressed size based on a height in a second display area of the display unit 160. Because the above-mentioned compression can be achieved through a conventional compression algorithm, a detailed description of the compression algorithm will be omitted.

The memory unit 130 includes a first text buffer 136 and a second text buffer 138 in accordance with an embodiment of the present invention. When the direction sensing unit 170 generates the first and third direction signals, the first text buffer 136 stores information about a size of a first font of display data. In an embodiment of the present invention, it is assumed that the first font size is 18*19. When the direction sensing unit 170 generates the second and fourth direction signals, the second text buffer 138 stores information about a size of a second font of display data. In this embodiment of the present invention, it is assumed that a second font size is 12*14.

A control unit 110 performs overall operation of the wireless terminal in accordance with an embodiment of the present invention. Alternatively, the control unit 110 may include the data processing unit 120. More specifically, the control unit 110 controls an operation for sensing a display direction of the wireless terminal and a display operation for allowing the user to view display data in the standard direction in accordance with an embodiment of the present invention.

In accordance with an embodiment of the present invention, the controller 110 performs a control operation such that data is displayed in the first picture size stored in the first picture buffer 132 after the display data is output in the standard direction when the direction sensing unit 170 generates the first direction signal. In accordance with an embodiment of the present invention, the control unit 110 performs a control operation such that data is displayed in the second picture size stored in the second picture buffer 134 after the display data is rotated by 90° when the direction sensing unit 170 generates the second direction signal. In accordance with the embodiment of the present invention, the control unit 110 performs a control operation such that data is displayed in the first picture size stored in the first picture buffer 132 after the display data is rotated by 180° when the direction sensing unit 170 generates the third direction signal. In accordance with an embodiment of the present invention, the control unit 110 performs a control operation such that data is displayed in the second picture size stored in the second picture buffer 134 after the display data is rotated by 270° when the direction sensing unit 170 generates the fourth direction signal.

A camera unit 140 captures picture data, and includes a camera sensor for capturing picture data and converting a captured optical signal into an electrical signal, and a signal processor for converting an analog picture signal captured by the camera sensor into digital data. Here, it is assumed that the camera sensor is a charge coupled device (CCD) sensor, and the signal processor can be implemented by a digital signal processor (DSP). The camera sensor and the signal processor can be integrated in a single body, or can be separate stand alone units.

A picture processing unit 150 performs a function for generating display data to display a picture signal output from the camera unit 140. The picture processing unit 150 processes the picture signal output from the camera unit 140 in frame units. The picture processing unit 150 outputs the frame picture data appropriate to the characteristics and size of the display unit 160.

The picture processing unit 150 includes a picture coder-decoder (CODEC), and performs a function for compressing the frame picture data displayed on the display unit 160 according to a preset compression scheme or for decoding the compressed frame picture data into original frame picture data. Here, the picture CODEC can be a Joint Picture Experts Group (JPEG) CODEC, Moving Picture Experts Group 4 (MPEG-4) CODEC, Wavelet CODEC and so on. It is assumed that the picture processing unit 150 has an on-screen display (OSD) function, and the picture processing unit 150 can output on-screen data based on the size of the picture to be displayed according to a control operation of the control unit 110.

The display unit 160 displays a picture signal output from the picture processing unit 150 in the form of a picture, and displays user data output from the control unit 110. Here, the display unit 160 can use a liquid crystal display (LCD). In case of the LCD, the display unit 160 can comprise a LCD controller, a memory capable of storing image data, a LCD element, and so on. When the LCD is implemented using a touch-screen system, the LCD can serve as an input unit.

More specifically, the display unit 160 includes a first display area and a second display area in accordance with an embodiment of the present invention. When the folder of the wireless terminal is rotated by 0° and 180°, the direction sensing unit 170 generates the first and third direction signals. In this case, the first display area is used which has a size of a display area capable of displaying data. In this embodiment of the present invention, it is assumed that the size of the first display area is 176*220, and is the same as that of the first picture stored in the first picture buffer. When the folder of the wireless terminal is rotated by 90° and 270°, the direction sensing unit 170 generates the second and fourth direction signals. In this case, the second display area is used which has a size of a display area capable of displaying data. In this embodiment of the present invention, the size of the second display area is 220*176, and is a state in which horizontal and vertical sizes of the first display area are switched.

The direction sensing unit 170 senses a direction in which the wireless terminal is placed, and then outputs a direction sensing signal to the control unit 110. That is, the direction sensing unit 170 performs a function for sensing a direction according to a position in which the wireless terminal is placed, and outputting the direction sensing signal to the control unit 110. Here, the direction sensing unit 170 can be implemented in various forms.

FIGS. 3A to 3E are diagrams illustrating positions of the direction sensing unit 170 in accordance with an embodiment of the present invention. In the embodiment of the present invention, a main body housing of the wireless terminal includes four sensors. One fixed magnet is mounted in the folder housing of the wireless terminal. It is assumed that four direction positions in which the display unit 160 of the wireless terminal is placed are sensed according to a north (N) or south (S) magnetic pole (or field) sensed by the sensors. In an embodiment of the present invention, it is assumed that the direction sensors are Hall-effect integrated circuits (ICs). In accordance with this embodiment of the present invention, a mounting position of each sensor or the magnet and the number of sensors or magnets can vary according to the wireless terminal to which they are applied.

Referring to FIGS. 3A to 3E, the direction sensing unit 170 includes one fixed magnet 350 mounted in the folder housing of the wireless terminal, and four Hall sensors 311, 312, 321, and 322 mounted in the main body housing of the wireless terminal for sensing a pole of the magnet 350 and generating a direction sensing signal. In the embodiment of the present invention illustrated in FIG. 3, it is assumed that the two Hall sensors 311 and 312 of the four Hall sensors sense the N pole of the magnet and are mounted to a front surface of a printed circuit board (PCB) of the main body housing that comes in contact with the folder housing of the wireless terminal, and the remaining two Hall sensors 321 and 322 sense the S pole of the magnet and are mounted to a rear surface of a PCB of the main body housing of the wireless terminal.

Alternatively, the two Hall sensors 311 and 312 of the four Hall sensors can sense the S pole of the magnet and can be mounted to the front surface of the PCB of the main body housing that comes in contact with the folder housing of the wireless terminal, and the remaining two Hall sensors 321 and 322 can sense the N pole of the magnet and can be mounted to the rear surface of the PCB of the main body housing of the wireless terminal.

The fixed magnet 350 is not limited to a mounting position in the folder of the wireless terminal, and can be mounted in the main body housing. The sensors 311, 312, 321, and 322 do not need to be limited to mounting positions in the main body housing of the wireless terminal, and can be mounted in the folder of the wireless terminal. For reference, FIG. 3B illustrates a first direction in which the folder of the wireless terminal is rotated by 0°. FIG. 3C illustrates a fourth direction in which the folder of the wireless terminal is rotated by 270°. FIG. 3D illustrates a second direction in which the folder of the wireless terminal is rotated by 90°. FIG. 3E illustrates a third direction in which the folder of the wireless terminal is rotated by 180°.

Figure 3A:
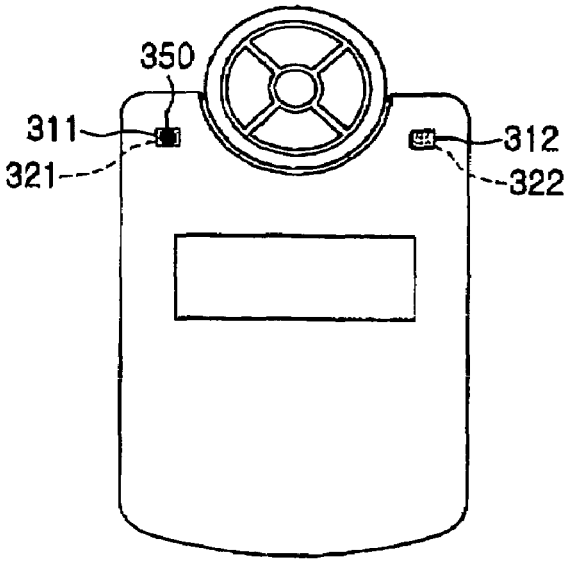
FIGS. 3A to 3E are diagrams illustrating positions of the wireless terminal in accordance with an embodiment of the present invention.
Figure 3B:
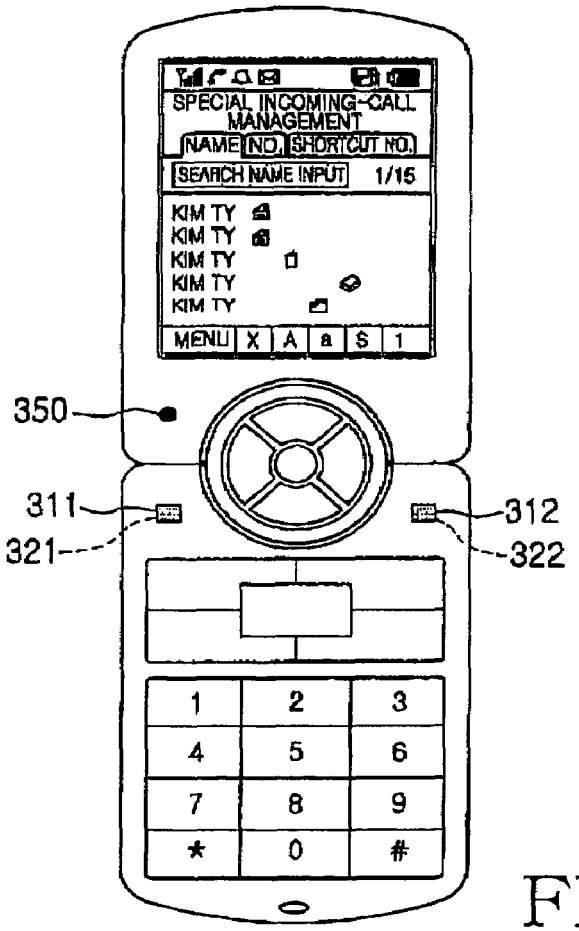
Figure 3C:
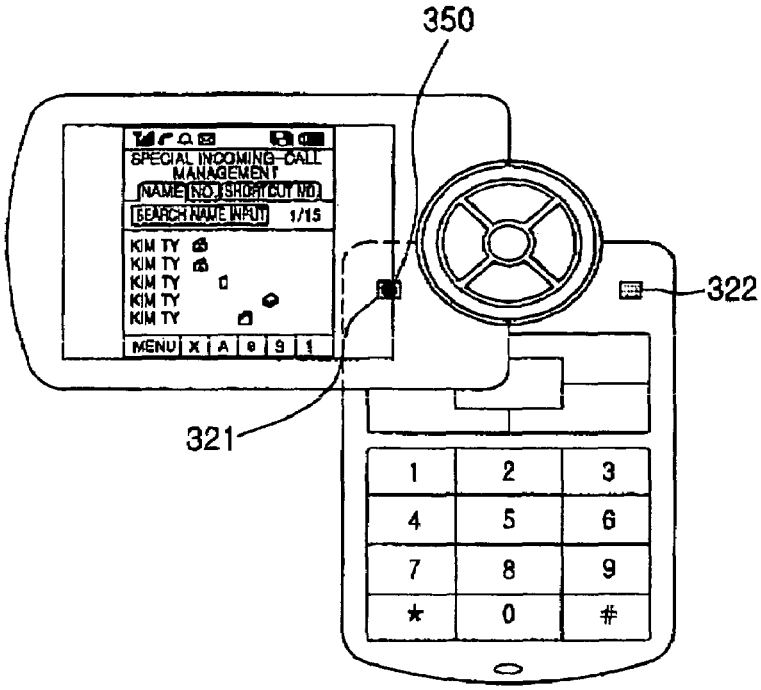
Figure 3D:
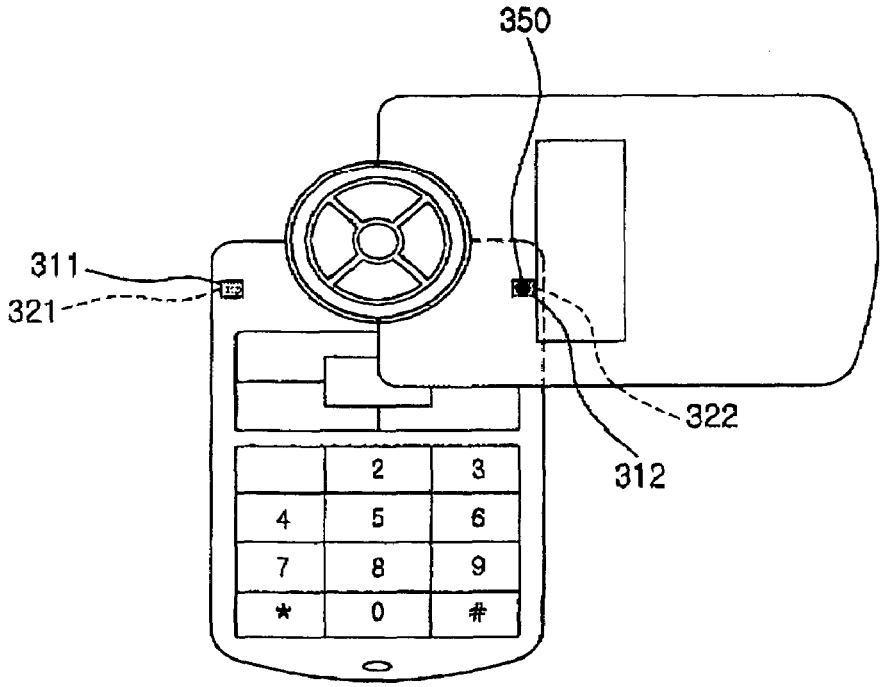
Figure 3E:
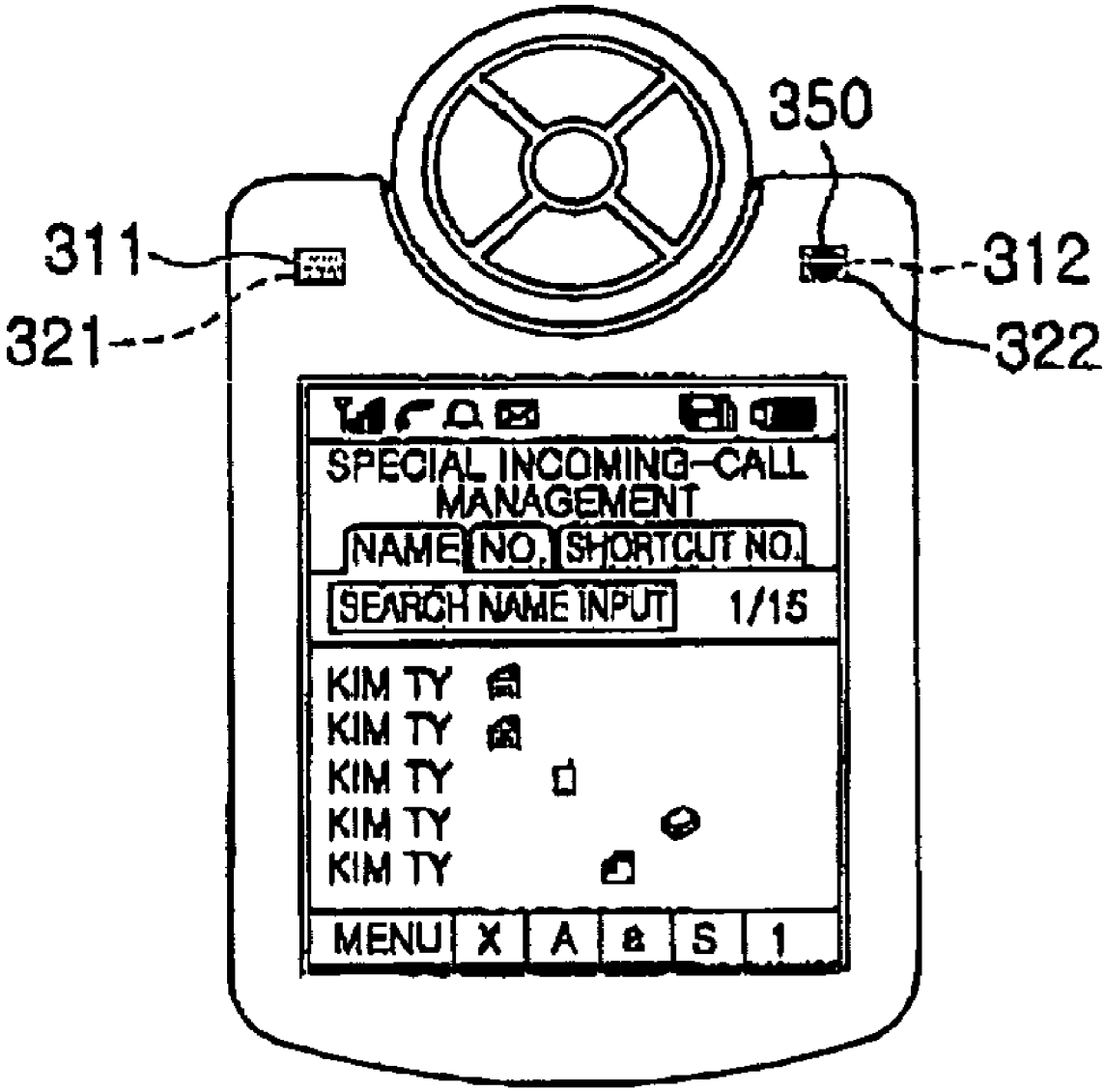

In a state in which the folder of the wireless terminal is closed as illustrated in FIG. 3A, the first sensor 311 senses the N pole of the magnet 350. When the folder of the wireless terminal is open and the first to fourth Hall sensors 311, 312, 321, and 322 do not sense the pole of the magnet, a first direction sensing signal is generated. Alternatively, when no direction sensing signal is output from any Hall sensor, the direction sensing unit 170 generates the first direction sensing signal.

When the second Hall sensor 312 senses the N pole of the magnet 350 as illustrated in FIG. 3D, the direction sensing unit 170 generates a second direction sensing signal. When the third Hall sensor 321 senses the S pole of the magnet 350 as illustrated in FIG. 3C, the direction sensing unit 170 generates a fourth direction sensing signal. When the fourth Hall sensor 322 senses the S pole of the magnet 350 as illustrated in FIG. 3E, the direction sensing unit 170 generates a third direction sensing signal.

Figure 4:
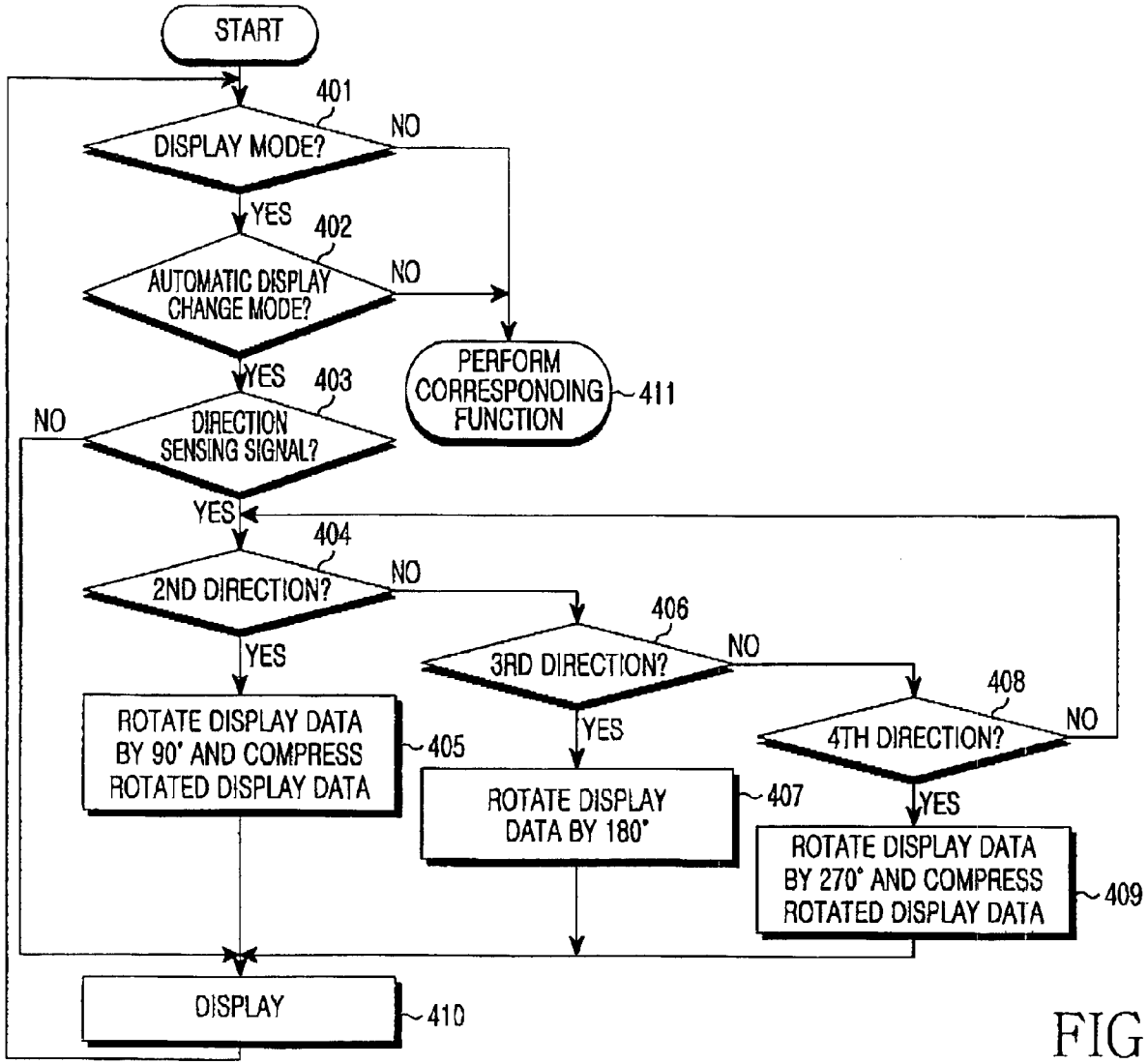
FIG. 4 is a flow diagram illustrating a method for controlling a display operation in the wireless terminal in accordance with an embodiment of the present invention.
Figure 5A:
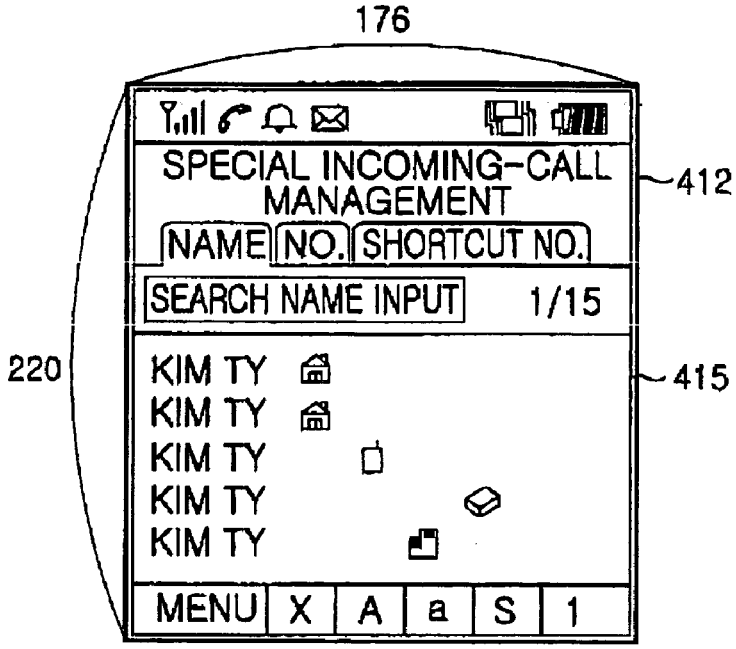
FIGS. 5A to 5C are diagrams illustrating the procedure of FIG. 4.
Figure 5B:
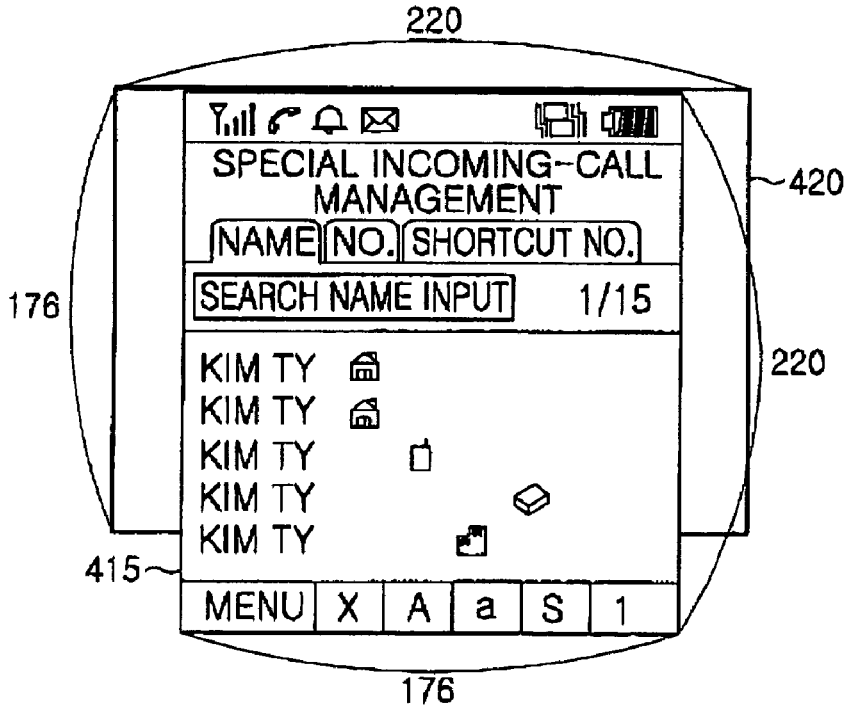
Figure 5C:
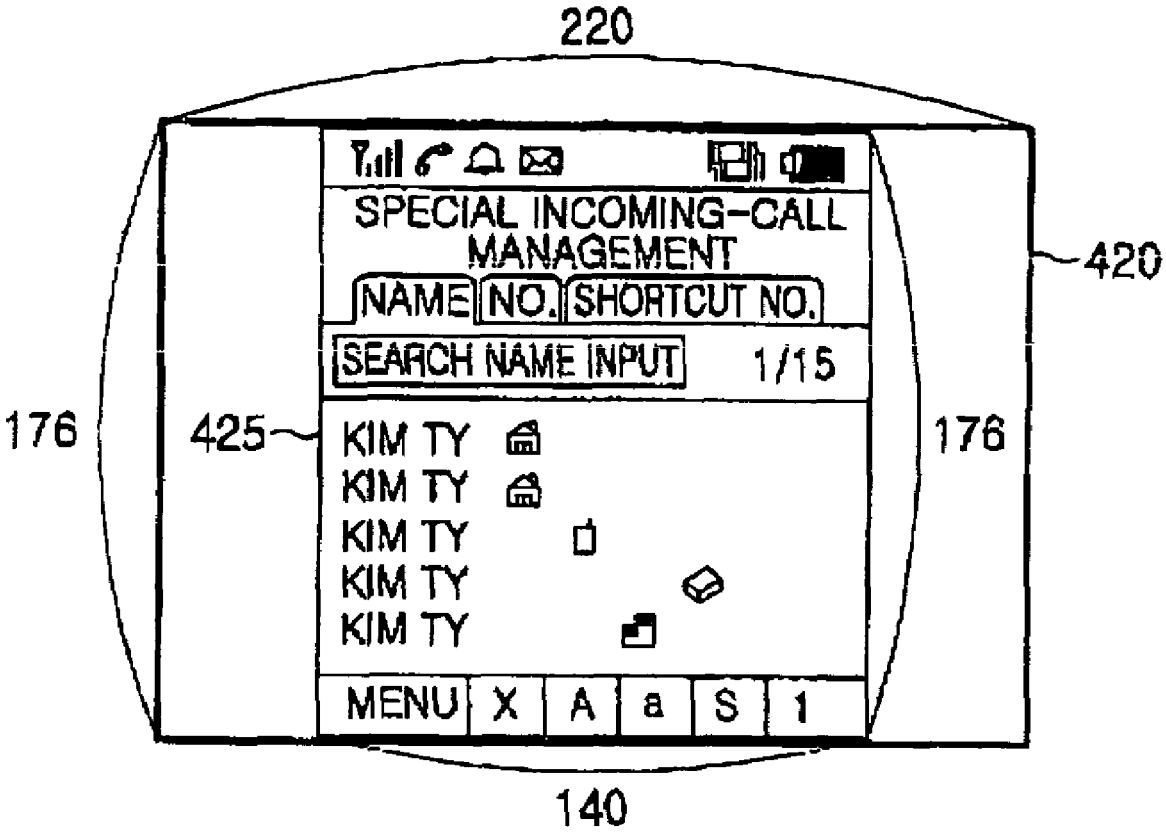

FIG. 4 is a flow diagram illustrating a procedure for displaying a picture in the wireless terminal in accordance with an embodiment of the present invention. FIGS. 5A to 5C illustrate the procedure of FIG. 4, and illustrate a display area of the display unit 160, and sizes of a picture and a screen for displaying data of the display area.

A method for displaying a picture in the wireless terminal with the direction sensing unit 170 constructed as illustrated in FIGS. 3A and 3E will be described with reference to FIG. 4.

Referring to FIG. 4, the control unit 110 checks if a current mode is a display mode in step 401. Here, the display mode is an operating mode in which the main body housing of the wireless terminal is spaced from the folder housing and a picture is displayed on the display unit 160. Alternatively, the display mode can be an operating mode in which a picture taken by the camera unit 140 is processed by the picture processing unit 150 in a camera mode and is displayed on the display area of the display unit 160.

When the wireless terminal performs a text communication function in a data communication mode, the display area is used to display all text information. When the wireless terminal performs a video mail communication function, the display area displays a video signal received by the wireless terminal.

When an automatic display change mode is set in the display mode, the control unit 110 senses the set automatic display change mode in step 402. Here, the automatic display change mode is an operating mode for automatically controlling a direction of a picture to be displayed on the display unit 160 according to a direction sensing signal of the direction sensing unit 170. Accordingly, when the automatic display change mode is not set, the control unit 110 controls the picture to be displayed in the standard direction (i.e., the first direction at an angle 0°), regardless of an output signal of the direction sensing unit 170.

If the display mode in step 401 or the automatic display change mode in step 402 are not set, the method proceeds to step 411 where a corresponding function is performed.

In step 403, when the automatic display change mode is set, the control unit 110 checks if a direction sensing signal is output from the direction sensing unit 170. If a direction sensing signal is output from the direction sensing unit 170, the control unit 110 senses and reads the direction sensing signal output from the direction sensing unit 170.

At this point, no signal is output from the Hall sensors 311, 312, 321, and 322, the direction sensing unit 170 generates the first direction sensing signal in step 403. As illustrated in FIG. 3A, the first Hall sensor 311 senses the N pole of the magnet 350 in a state in which the folder of the wireless terminal is closed. However, when the first Hall sensor 311 does not sense the N pole of the magnet 350 in a state in which the folder of the wireless terminal is open, the direction sensing unit 170 can generate the first direction sensing signal. Subsequently, the control unit 110 reads the first direction sensing signal from the direction sensing unit 170.

Because the case where the first direction sensing signal is generated is a state in which the folder of the wireless terminal is placed in the standard direction, the displayed picture is maintained in the standard direction. In this case, the display unit 160 has a first display area 412 in which horizontal and vertical sizes are 176*220 as illustrated in FIG. 5A. Accordingly, the control unit 110 controls display data to be displayed in the standard direction appropriate to the first picture size 415 of 176*220 that is the same as that of the first display area 412 of the display unit 160 in step 410. At this point, it is preferred that a font of the display data is displayed in a first font size of 18*19 stored in the first text buffer. FIG. 3B illustrates a state in which the wireless terminal is placed in the standard direction as illustrated in FIG. 5A.

When the second Hail sensor 312 senses the N pole of the magnet 350 as illustrated in FIG. 3D, the direction sensing unit 170 generates a second direction signal and the control unit 110 reads the second direction signal from the direction sensing unit 170 in step 404. The case where the second direction signal is generated is a state in which the folder of the wireless terminal is rotated by 90° from the standard direction. In this case, the picture displayed on the display unit 160 is rotated by 90°, and the display unit 160 has a second display area 420 in which horizontal and vertical sizes are 220*176 as illustrated in FIG. 5B.

The control unit 110 proceeds to step 405 to control the second display area 420 to display data of a second display size 425 rotated by 90°.

The control unit 110 compresses the display data rotated by 90°, that is, the display data based on the first picture size 415 of 176*220 such that display data appropriate to the second picture size 425 can be displayed on the second display area 420 of 220*176 as illustrated in FIG. 5B, in step 405. Subsequently, the control unit 110 displays the compressed display data appropriate to the second picture size 425 of 140*176 stored in the second picture buffer as illustrated in FIG. 5C in step 410. At this point, start position information (140,0) and end position information (140,176) of the second picture size 425 associated with the second display area 420 are stored in advance in the second picture buffer. It is preferred that a font of the display data with the second picture size 425 is displayed in a second font size of 12*14 stored in the second text buffer. Accordingly, the user of the wireless terminal can view a picture displayed on the display unit 160 in the standard direction even when the wireless terminal is rotated by 90° in step 410.

On the other hand, when the fourth Hall sensor 322 senses the S pole of the magnet 350 as illustrated in FIG. 3E, the direction sensing unit 170 generates a third direction signal and the control unit 110 reads the third direction signal from the direction sensing unit 170 in step 406. The case where the third direction signal is generated is a state in which the folder of the wireless terminal is rotated by 180° from the standard direction. In this case, the display unit 160 has the first display area 412 in which horizontal and vertical sizes are, respectively, 176*220 as illustrated in FIG. 5A. The control unit 110 proceeds to step 407 to control the first display area 412 to display data of the first display size 415 rotated by 180°. At this point, it is preferred that a font of the display data with the first picture size 415 is displayed in the first font size of 18*19 stored in the first text buffer. Accordingly, the user of the wireless terminal can view a picture displayed on the display unit 160 in the standard direction even when the wireless terminal is rotated by 180°, in step 410.

Finally, when the third Hall sensor 321 senses the S pole of the magnet 350 as illustrated in FIG. 3C, the direction sensing unit 170 generates a fourth direction signal and the control unit 110 reads the fourth direction signal from the direction sensing unit 170 in step 408. The case where the fourth direction signal is generated is a state in which the folder of the wireless terminal is rotated by 270° from the standard direction. In this case, the display unit 160 displays the picture rotated by 270°, and has the second display area 420 in which horizontal and vertical sizes are 220*176 as illustrated in FIG. 5B. The control unit 110 proceeds to step 409 to control the second display area 420 to display data of the second display size 425 after the picture is rotated by 270° from the standard direction as illustrated in FIG. 5C.

The control unit 110 compresses the display data rotated by 270°, that is, the display data based on the first picture size 415 of 176*220 such that data appropriate to the second picture size 425 can be displayed on the second display area 420 of 220*176 as illustrated in FIG. 5B, in step 409. Subsequently, the control unit 110 displays the compressed display data appropriate to the second picture size 425 of 140*176 stored in the second picture buffer as illustrated in FIG. 5C in step 410. At this point, start position information (140,0) and end position information (140,176) of the second picture size 425 associated with the second display area 420 are stored in the second picture buffer in advance. It is preferred that a font of the display data with the second picture size 425 is displayed in the second font size of 12*14 stored in the second text buffer. Accordingly, the user of the wireless terminal can view a picture displayed on the display unit 160 in the standard direction even when the wireless terminal is rotated by 270°, in step 410. FIG. 3C illustrates a state in which the wireless terminal is rotated by 270° from the standard direction.

A method capable of displaying data appropriate to a value of the first picture size stored in the first picture buffer when the first and third directions are sensed because the first picture buffer stores start and end position information serving as address values of the first picture size, has been described in an embodiment of the present invention. A method capable of displaying data appropriate to a value of the second picture size stored in the second picture buffer when the second and fourth directions are sensed because the second picture buffer stores start and end position information serving as an address values of the second picture size, has been described in an embodiment of the present invention. Alternatively, the first and second picture buffers can store display data appropriate to the picture sizes as well as the address values associated with the picture sizes. Accordingly, the display data of the first picture stored in the first picture buffer can be output and displayed as it is when the first and third directions are sensed, and the display data of the second picture stored in the second picture buffer can be output and displayed as it is when the second and fourth directions are sensed.

As apparent from the above description, the present invention can sense a direction in which a wireless terminal is placed to rotate and display data in the sensed direction, such that a user can view a picture in a standard direction regardless of a position in which the wireless terminal is placed.

Although certain embodiments of the present invention have been disclosed for illustrative purposes, those skilled in the art will appreciate that various modifications, additions and substitutions are possible, without departing from the scope of the present invention. Therefore, the present invention is not limited to the above-described embodiments, but is defined by the following claims, along with their full scope of equivalents.

What is claimed is:

1. A display apparatus for use in a wireless terminal having a folder that is rotatable with respect to a base, comprising:

a direction sensing unit for sensing a direction according to a position in which the folder of the wireless terminal is placed relative to the base, and generating one of first to fourth direction sensing signals according to the direction sensed;

a control unit for outputting display data in a standard direction when the first direction sensing signal is generated, outputting the display data rotated by 90° and compressed when the second direction sensing signal is generated, outputting the display data rotated by 180° when the third direction sensing signal is generated, and outputting the display data rotated by 270° and compressed when the fourth direction sensing signal is generated;

a memory unit comprising:

a first picture buffer for storing a value indicating a size of a first picture displaying the display data when one of the first and third direction sensing signals is generated, and a second picture buffer for storing a value indicating a size of a second picture displaying the display data when one of the second and fourth direction sensing signals is generated; and a display unit for displaying one of the display data in the standard direction, the display data rotated by 90° and compressed, the display data rotated by 180° and the display data rotated by 270° and compressed.

2. The display apparatus according to claim 1, wherein the memory unit comprises:

the first picture buffer for storing start and end position information of the first picture size; and the second picture buffer for storing a start position and an end position information of the second picture size.

3. A display apparatus for use in a wireless terminal, comprising:

a direction sensing unit for sensing a direction according to a position in which the wireless terminal is placed, and generating first to fourth direction sensing signals;

a control unit for outputting display data in a standard direction when the first direction sensing signal is generated, outputting the display data rotated by 90° and compressed when the second direction sensing signal is generated, outputting the display data rotated by 180° when the third direction sensing signal is generated, and outputting the display data rotated by 270° and compressed when the fourth direction sensing signal is generated;

a memory unit comprising:

a first picture buffer for storing a value indicating a size of a first picture displaying the display data when the first and third direction sensing signals are generated, a second picture buffer for storing a value indicating a size of a second picture displaying the display data when the second and fourth direction sensing signals are generated, a first text buffer for storing a value indicating a size of a first font to be displayed when the first and third direction sensing signals are generated, and a second text buffer for storing a value indicating a size of a second font to be displayed when the second and fourth direction sensing signals are generated; and a display unit for displaying the display data.

4. A display method for use in a wireless terminal having a folder that is rotatable with respect to a base, comprising:

sensing a direction signal according to a position in which the folder of the wireless terminal is placed relative to the base;

determining, as a first direction signal, a case when no direction signal is sensed, and outputting and displaying display data in a standard direction;

rotating the display data by 90°, compressing the rotated display data, and displaying the compressed rotated display data, when the sensed direction signal is a second direction signal;

rotating the display data by 180°, and displaying the rotated display data, when the sensed direction signal is a third direction signal; and rotating the display data by 270°, compressing the rotated display data, and displaying the compressed rotated display data, when the sensed direction signal is a fourth direction signal.

5. The display method according to claim 4, wherein outputting and displaying the display data in the standard direction comprise:

rotating the display data by 0°; and displaying the display data rotated by 0° in a first picture size.

6. The display method according to claim 5, wherein displaying comprises:

displaying the display data in a first font size.

7. The display method according to claim 4, wherein displaying the display data when the sensed direction signal is the second direction signal comprises:

rotating the display data by 90°;

compressing the display data rotated by 90° into a second picture size; and displaying the compressed display data.

8. The display method according to claim 7, wherein displaying comprises:

displaying the compressed display data in a second font size.

9. The display method according to claim 4, wherein displaying the display data when the sensed direction signal is the third direction signal comprises:

rotating the display data by 180°; and displaying the display data rotated by 180° in a first picture size.

10. The display method according to claim 9, wherein displaying comprises:

displaying the compressed display data in a first font size.

11. The display method according to claim 4, wherein displaying the display data when the sensed direction signal is the fourth direction signal comprises:

rotating the display data by 270°;

compressing the display data rotated by 270° into a second picture size; and displaying the compressed display data.

12. The display method according to claim 11, wherein displaying comprises:

displaying the compressed display data in a second font size.

13. An apparatus for directionally displaying images on a screen, comprising:

the screen and a magnet disposed in a folder;

a plurality of sensors disposed in a base for detecting a direction according to a position of the folder relative to said base, said base and folder being pivotally connected via a connector; and a controller for receiving directional signals from the plurality of sensors indicative of the position of the folder relative to said base, outputting an image in a standard direction when a first directional signal is received, outputting the image rotated by 90° and compressed when a second directional signal is received, outputting the image rotated by 180° when a third directional signal is received, outputting the image rotated by 270° and compressed when a fourth directional signal is received, and displaying the image in an upright position relative to the position of the folder, wherein the displayed image is one of the image in the standard direction, the image rotated by 90° and compressed, the image rotated by 180° and the image rotated by 270° and compressed.

14. The apparatus of claim 13, wherein the positions of the folder comprise 0° degrees, 90° degrees, 180° degrees, and 270° degrees.

15. The apparatus of claim 14, wherein the 0° degree position of the folder comprises the standard direction for viewing the screen.

16. The apparatus of claim 13, wherein the controller compresses image data and reduces a font size of data for display on the screen when the folder is rotated at 90° degrees or 270° degrees.

17. The apparatus of claim 13, wherein the image on the screen is rotated an equal but opposite angle from the rotation of the folder to maintain the image on the screen in an upright position relative to the position of the folder.

18. The apparatus of claim 13, further comprising:

a camera for capturing at least one of still images and moving images.

19. The apparatus of claim 13, further comprising:

a memory for storing image data and text data.

20. The apparatus of claim 19, wherein the memory comprises a first picture buffer, a second picture buffer, a first text buffer and a second text buffer.

* * * * *